US007644836B2

(12) United States Patent
Morin et al.

(10) Patent No.: US 7,644,836 B2
(45) Date of Patent: Jan. 12, 2010

(54) CONTAINER FOR A STACK OF INDIVIDUALLY REMOVABLE PAPER PRODUCTS

(75) Inventors: Emmanuelle Morin, Vanves (FR); Thami Chihani, Mölnlycke (SE); Ann Chihani, legal representative, Mölnlycke (SE)

(73) Assignee: SCA Hygiene Products AB, Gothenburg (SE)

( * ) Notice: Subject to any disclaimer, the term of this patent is extended or adjusted under 35 U.S.C. 154(b) by 474 days.

(21) Appl. No.: 11/596,081

(22) PCT Filed: Apr. 18, 2005

(86) PCT No.: PCT/EP2005/004107

§ 371 (c)(1),
(2), (4) Date: Nov. 9, 2006

(87) PCT Pub. No.: WO2005/113381

PCT Pub. Date: Dec. 1, 2005

(65) Prior Publication Data

US 2009/0020547 A1 Jan. 22, 2009

(30) Foreign Application Priority Data

May 13, 2004 (DE) ..... 20 2004 007 773 U

(51) Int. Cl.
*B65H 1/04* (2006.01)

(52) U.S. Cl. ..... 221/50; 221/305; 206/494

(58) Field of Classification Search ..... 221/50, 221/305; 206/494, 460, 804, 813
See application file for complete search history.

(56) References Cited

U.S. PATENT DOCUMENTS 4,574,952 A * 3/1986 Masui ..... 221/48
2003/0168467 A1* 9/2003 Thoms ..... 221/48

FOREIGN PATENT DOCUMENTS

WO 96/17794 6/1996

* cited by examiner

*Primary Examiner*—Gene Crawford
*Assistant Examiner*—Timothy R Waggoner
(74) *Attorney, Agent, or Firm*—Young & Thompson

(57) ABSTRACT

A container for a stack of individually removable paper products (9) such as facial tissues, handkerchiefs, towels and the like, or similar products made of non-woven material is described. The container has an upper wall (2), in which a withdrawal opening is formed which is closed by a tear-offable lid (8) and a cavity accommodating the stack of products. The lid (8) has on its inner surface (12) an adhesive or bonding surface (11) by which the uppermost paper product (10) of the stack adheres, preferably detachably, to the lid (8).

6 Claims, 1 Drawing Sheet

CONTAINER FOR A STACK OF INDIVIDUALLY REMOVABLE PAPER PRODUCTS

TECHNICAL FIELD

The invention relates to a container for a stack of individually removable paper products, in particular tissue products such as facial tissues, handkerchiefs, towels and the like, or products of non-woven material.

BACKGROUND ART

Such containers are known and on the market. In particular for very thin paper products such as facial tissues, it is difficult to grip the top tissue securely with the fingers through the withdrawal opening and remove it from the container. The opening is often damaged or the appearance of the container spoiled. Also it occurs that on an attempt to remove the top tissue, instead of one tissue several tissues are removed simultaneously. These tissues too can be torn or crumpled.

It is already known to solve this problem by applying a sticker to the top tissue which serves as a handle for removal.

DISCLOSURE OF INVENTION

The object of the invention is to create a container of the type cited in the preamble of claim 1, which guarantees secure removal of the first and top product from the container without damaging this product, the container or container opening, and without removing several products undesirably at the same time. This is to be achieved with as simple as possible a design means in conjunction with as simple as possible a production of the container, and filling of the container with a stack of paper products in as simple and problem-free a manner as possible, in particular when as individual products these are designed very fine and thin as is the case with facial tissues.

The object is achieved according to the invention in that the lid on its inside has an adhesive or bonding surface by means of which the top paper product of the stack adheres preferably detachably to the lid, in compliance with claim 1.

This solution has a great advantage in that the first and uppermost paper product alone is withdrawn purely automatically and simply, since the lid with adhesive or bonding surface adheres to the first uppermost paper product and carries this when the lid, which is preferably held closed by a perforation line, is opened.

Such a solution has the advantage that nothing need be changed on the paper products themselves. The changes are container-related, which is easier to achieve. Because the top and first paper product of the stack adheres detachably to the lid, after opening the lid this paper product can easily be detached from the adhesive surface. If the lid is closed again without the next paper product partly protruding with a view to improved grip, it is possible that the closed lid with its adhesive surface will again adhere to the new top product which is withdrawn after opening of the lid. If the lid is fully removed due to a complete perforation line, which is usually the case, the easier removal of the next paper product is achieved in that on complete withdrawal of the top sheet-like paper product, the next is partly also withdrawn and can be easily gripped etc.

The adhesive surface can for example be coated with an adhesive or provided with a spot of adhesive that is generally known for releasable closing of containers. However a mechanical bonding part can also be used in the form of a multiplicity of hooks which grip into the fibre structure of the paper product and hence create adhesion.

According to a refinement of the invention the container is a folded container formed from a blank with an upper wall with the withdrawal opening and, arranged spaced therefrom in the assembled state, a substantially parallel base wall, where on the inner surface of the base wall is formed a separating surface against which the adhesive surface lies in the collapsed state of the container and can easily be detached.

The containers in the stack reach the filling machine in the collapsed state and are normally also stored in this state. Due to contact between the adhesive surface and the separating surface, the adhesive surface does not lose its adhesive effect before filling with paper products but on assembly of the box can easily be detached from the separating surface. If the filled container is then transported further on the side of the withdrawal opening, this leads to adhesion between the top and first paper product and the lid.

The separating surface is preferably formed in that a separating material is applied to the inside of the base wall. However a flat piece can also be applied to the inside of the base wall as a separating layer. Finally it would also be possible for at least the inside of the container material to have a surface with a separating function.

The present invention can be employed for all different types of tissue paper products known in the art, such as handkerchiefs, facials, toilet paper, household towels or napkins, however household towels and napkins are preferably used.

According to the present invention the absorbent tissue paper contains an adhesive applied to at least a part of its surface. Such an adhesive should be non-toxic.

Compounds suitable as adhesives of the present invention include, but are not limited to, commonly available glue, e.g. based on starch or modified starch such as methyl cellulose, carboxylic methyl cellulose and adhesive polymers and polymers of synthetic resins, rubbers, polypropylene, polyisobutylene, polyurethane, polyacrylics, polyvinyl acetate and polyvinyl alcohol.

Suitable adhesive polymers include, but are not limited to, block co-polymers containing polystyrene endblocks, and polyisoprene, polybutadiene, and/or poly ethylene-butylene midblocks: polyolefins such as polyethylene, polypropylene, amorphous polypropylene, polyisoprene, polyisobutylene and polyethylene propylene, ethylene-vinylacetate copolymers; poly(vinylethylene-co-1,4-butadiene); natural rubber (poly cis-isoprene); polyacrylic acids, preferably 2-ethylhexylacrylate and iso-octylacrylate, and polymethacrylic acid or their salts; polydimethylsiloxane, polydiphenylsiloxane, poly methyl phenyl siloxane; polyvinyl acetate, polyvinyl alcohol; and mixtures thereof.

Adhesive polymers useful for the present invention can further include thermoplastic polymers such as A-B-A triblock copolymers, A-B diblock copolymers, A-B-A-B-A-B multiblock copolymers, radial block copolymers and grafted versions thereof; homopolymers, copolymers and terpolymers of ethylene; and homopolymers, copolymers and terpolymers of propylene; and mixtures thereof. Radial block copolymers include Y-block and star polymers as well as other configurations. The A-B-A block copolymers useful herein are those described in U.S. Pat. No. 4,136,699, which is incorporated herein by reference. Examples include those polymers available under the Kraton™ G series from Shell Chemical Co. There are various grades available including Kraton™ G-1726, Kraton™ G-1650, Kraton™ G-1651, Kraton™ G-1652, Kraton™ G-1657, all saturated A-B diblock/

A-B-A triblock mixtures with ethylene/butylenes midblocks; Kraton™ D-1112 a high percent A-B diblock linear styrene-isoprene-styrene polymer; Kraton™ D-1107 and Kraton™ D-1111, primarily A-B-A triblock linear styrene-isoprene-styrene block copolymers; Kraton™ D4433X, a linear styrene-isoprene-styrene "SIS" block copolymer with an oil content of 30% by weight and Kraton™ D1184, a high molecular weight styrene-butadiene-styrene "SBS" block copolymer both available from Shell Chemical Co.; Stereon™ 840A and Stereon™ 841A, A-B-A-B-A-B multiblock SBS block copolymers available from Firestone; Europrene™ Sol T-193B, a linear SIS block copolymer available from Enichem Elastomers; Europrene™ Sol T-190, a linear styrene-isoprene-styrene block copolymer and Europrene™ Sol T-163, a radial SBS block copolymer both also available from Enichem Elastomers; Vector™ 4461-D, a linear SBS block copolymer available from Exxon Chemical Co.; Vector™ 4111, 4211 and 4411, fully coupled linear SIS block copolymers containing different weight percentages of styrene endblock; and Vector™ 4113, a highly coupled linear SIS block copolymer also available from Exxon Chemical Co.; and DPX-550, DPX-551 and DPX-552 radial SIS block copolymers available from Dexco Polymers. This list is not exclusive and there are numerous grades of block copolymers available from various sources for such adhesives, especially so called hot melt adhesives. These polymers may be used alone, or in any combinations.

Other adhesive polymers include a substantially linear copolymer having the general configuration A-B-A wherein the A block can be polystyrene and the B block can be ethylene-butylene, ethylene-propylene, isoprene, butadiene or mixtures thereof, and preferably the B block is ethylene-butylene or ethylene-propylene. Adhesive polymers of this type, such as Kraton™ G—from Shell Chemical Co., from Elf Atochem North America under the tradename of Lotryl™ including 35 BA 900 and 35 BA 1000; from Exxon Chemical Co. under the tradename of Escorene™ including XW-23.AH and XW-22. These adhesive polymers can also have to be used in small concentrations with some of the block copolymers such as Kraton™ G-1651.

Other adhesive polymers include polyamides, polyesters, polyvinyl alcohol, polyvinyl pyrrolidone and copolymers thereof, polyurethanes; polystyrenes, polyepoxides; graft copolymers of vinyl monomers and polyalkylene oxide polymers and; aldehyde containing resins such as phenol-aldehyde, urea-aldehyde, melamine-aldehyde and the like.

Further suitable adhesive polymers are based on polymers having units derived from vinylamine compounds.

Other components which can be used as adhesives are conventional adhesive components soluble and dispersible in water such as glutine, casein, starch (also in modified form), dextrine, or mixtures thereof.

Suitable adhesives can also be formulated with so-called synthetic resins. Such resins include, among other materials, (a) natural and modified resins, (b) polyterpene resins, (c) phenolic modified hydrocarbon resins, (d) coumarone-indene resins, (e) aliphatic and aromatic petroleum hydrocarbon resins, (f) phthalate esters and (g) hydrogenated hydrocarbons, hydrogenated rosins, and hydrogenated rosin esters.

Additional useful adhesives are based on so-called acrylic adhesive polymer selected from a wide variety of polymers and copolymers derived from acrylic and/or methacrylic acid, or ester, amide and nitrile derivatives thereof. Mixtures of different polymers and copolymers can be used. These polymers and copolymers preferably have a glass transition temperature (Tg) of less than about 0° so that the mass of polymer is tacky at ambient temperatures. Examples of useful acrylate-based adhesive polymers include homopolymers and copolymers comprising isooctylacrylate, 2-ethylhexylacrylate, isoamylacrylate, nonylacrylate and butylacrylate and their copolymers or terpolymers with acrylic acid, methacrylic acid, acrylamide, methacrylamide, acrylonitrile and methacrylonitrile. It is also possible to incorporate nonpolar acrylic monomers whose homopolymers have a relatively high Tg such as, for example, isobornylacrylate (see, e.g., WO 95/13,331 and WO 95/13,328). Suitable pressure sensitive adhesives can optionally be formulated with synthetic resins in order to improve adhesion and introduce tack into the pressure sensitive adhesive, to achieve the adhesive characteristics desired herein.

The adhesive can be applied on the surface of the container either by spraying or by coating whereby the term coating also includes applying one or a few tapes which are being coated with adhesives.

However, it is also possible to use printing techniques such as the rotogravure printing technique or the flexographic printing technique for applying the adhesive to the tissue paper.

In case that the spraying technique is used the adhesive is either heated up to the melting point so that it will be transferred into a so called "hot melt" or the adhesive is applied in the form of an aqueous solution. Although it is possible to apply the adhesive during manufacturing of the tissue paper, it is preferred that the finished tissue paper should be treated with the adhesive. The delivery of the adhesive by means of a spraying device should be adjusted to the product flow speed to ensure that a selected amount of adhesive is applied at the selected part of the tissue paper. This can be achieved e.g. by using a photo-eye detection of a certain area of the tissue paper whereby at a certain line a signal will be transferred to the spraying device thereby initiating a shot of a certain amount of adhesive.

Applying the adhesive to the tissue paper can also be achieved by coating during of after manufacturing of such tissue paper using an offset-roll system. It is clearly preferred that applying the adhesive by means of an offset-roll system should be carried out after manufacturing of the tissue paper. In order to ensure that a selected amount of adhesive is placed in the desired area of the tissue paper, a photo-eye detection system controlling the drive of the offset rolls should be used.

If tissue paper is to be made out of pulp, the process essentially comprises a forming that includes the headbox and the forming wire portion, b the drying portion (TAD (through air drying)) or conventional drying on the yankee cylinder) that also usually includes the crepe process essential for tissues, c typically the monitoring and winding area.

Paper can be formed by placing the fibers, in an oriented or random manner, on one or between two continuously revolving wires of a paper making machine while simultaneously removing the main quantity of water of dilution until dry-solids contents of usually between 12 and 35% are obtained.

Drying the formed primary fibrous web occurs in one or more steps by mechanical and thermal means until a final dry-solids content of usually about 93 to 97%. In the case of tissue making, this stage is followed by the crepe process which crucially influences the properties of the finished tissue product in conventional processes. The conventional dry crepe process involves creping on a usually 4.5 to 6 m diameter drying cylinder, the so-called yankee cylinder, by means of a crepe doctor with the aforementioned final dry-solids content of the raw tissue paper (wet creping can be used if lower demands are made of the tissue quality). The creped, finally dry raw tissue paper (raw tissue) is then available for further processing into the paper product or tissue paper product according to the invention.

Instead of the conventional tissue making process described above, the use of a modified technique is possible in which an improvement in specific volume is achieved by a special kind of drying within process section b and in this way an improvement in the bulk softness of the thus made tissue paper is achieved. This process, which exists in a variety of subtypes, is termed the TAD (through air drying) technique. It is characterized by the fact that the "primary" fibrous web (like a nonwoven) that leaves the forming and sheet making stage is pre-dried to a dry-solids content of about 80% before final contact drying on the yankee cylinder by blowing hot air through the fibrous web. The fibrous web is supported by an air-permeable wire or belt (or TAD-fabric) and during its transport is guided over the surface of an air-permeable rotating cylinder drum (TAD-cylinder). Structuring the supporting wire or belt makes it possible to produce any pattern of compressed zones broken up by deformation in the moist state, also named moulding, resulting in increased mean specific volumes and consequently leading to an increase in bulk softness without decisively decreasing the strength of the fibrous web. Such a pattern is fixed in the area of the TAD-cylinder. Thereafter the pattern is further imprinted between the TAD-fabric and the Yankee-cylinder.

Creping may be conducted also during transfer of the paper sheet from the forming wire directly to the TAD-fabric or via a transfer fabric. For this creping the forming fabric runs faster than the following fabric receiving the sheet (rush transfer). For example, when applying the TAD technique for the production of raw tissue and the usual double-screen sheet formation in c-wrap configuration, for example, the so-called inner sheet-forming screen can thus be operated at a speed that is up to 40% faster than that of the next fabric or that of the subsequent felt, the initially formed and already pre-drained paper web being transferred to the next TAD fabric. This causes the still moist and as a result plastically deformable paper web to be internally broken up by compression and shearing, thereby rendering it more stretchable under load than a paper that has undergone neither "internal" nor external creping. This transfer of still plastically deformable paper web at a differential speed that simultaneously takes effect may also be brought about in other embodiments between a transfer fabric and the so-called TAD imprinting fabric or between two transfer fabrics.

Another possible influence on the softness and strength of the raw tissue lies in the production of a layering in which the primary fibrous web to be formed is built up by a specially constructed headbox in the form of physically different layers of fibrous material, these layers being jointly supplied as a pulp strand to the sheet making stage.

When processing the raw fibrous web or raw tissue paper into the final product (third process section), the following procedural steps are normally used individually or in combination: cutting to size (longitudinally and/or cross cutting), producing a plurality of plies, producing mechanical ply adhesion, volumetric and structural embossing, ply adhesion, folding, imprinting, perforating, application of lotions, smoothing, stacking, rolling up.

To produce multi-ply tissue paper products, such as handkerchiefs, toilet paper, towels or kitchen towels, an intermediate step preferably occurs with so-called doubling in which the raw tissue in the finished product's desired number of plies is usually gathered on a common multiply master roll.

The processing step from the raw tissue that has already been optionally wound up in several plies to the finished tissue product occurs in processing machines which include operations such as repeated smoothing of the tissue, edge embossing, to an extent combined with full area and/or local application of adhesive to produce ply adhesion of the individual plies (raw tissue) to be combined together, as well as longitudinal cut, folding, cross cut, placement and bringing together a plurality of individual tissues and their packaging as well as bringing them together to form larger surrounding packaging or bundles. The individual paper ply webs can also be pre-embossed and then combined in a roll gap according to the foot-to-foot or nested methods.

A tissue paper is defined as a soft absorbent paper having a low basis weight. One generally selects a basis weight of 8 to 30 g/m$^2$, especially 10 to 25 g/m$^2$ per ply. The total basis weight of multiple-ply tissue products is preferably equal to a maximum of 65 g/m$^2$, more preferably to a maximum of 50 g/m$^2$. Its density is typically below 0.6 g/cm$^3$, preferably below 0.30 g/cm$^3$ and more preferably between 0.08 and 0.20 g/cm$^3$.

The production of tissue is distinguished from paper production by the its extremely low basis weight and its much higher tensile energy absorption index (see DIN EN 12625-4 and DIN EN 12625-5). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper.

Moist tissue paper webs are usually dried by the so-called Yankee drying, the through air drying (TAD) or the impulse drying method.

The fibers contained in the tissue paper are mainly cellulosic fibres, such as pulp fibers from chemical pulp (e.g. Kraft sulfite and sulfate pulps), mechanical pulp (e.g. ground wood), thermo mechanical pulp, chemo-mechanical pulp and/or chemo-thermo mechanical pulp (CTMP). Pulps derived from both deciduous (hardwood) and coniferous (softwood) can be used. The fibers may also be or include recycled fibers, which may contain any or all of the above categories. The fibers can be treated with additives—such as fillers, softeners, such as quaternary ammonium compounds and binders, such as conventional dry-strength agents or wet-strength agents used to facilitate the original paper making or to adjust the properties thereof. The tissue paper may also contain other types of fibers, e.g. regenerated cellulosic fibres or synthetic fibers enhancing, for instance, strength, absorption, smoothness or softness of the paper.

Tissue paper may be converted to the final tissue product in many ways, for example, by embossing or laminating it into a multi-ply product, rolled or folded.

The term non-woven (ISO 9092, DIN EN 29092) is applied to a wide range of products which, in terms of their properties, are located between those of paper (cf. DIN 6730, May 1996) and cardboard (DIN 6730) on the one hand, and textiles on the other hand. As regards non-woven a large number of extremely varied production processes are used, such as the air-laid and spun-laced techniques as well as wet-laid techniques. The non-woven includes mats, non-woven fabrics and finished products made thereof. Non-wovens may also be called textile-like composite materials, which represent flexible porous fabrics that are not produced by the classic methods of weaving warp and weft or by looping. In fact, nonwovens are produced by intertwining, cohesive or adhesive bonding of fibres, or a combination thereof. The non-woven material can be formed of natural fibres, such as cellulose or cotton fibres, but can also consist of synthetic fibres, such as Polyethylene (PE), polypropylene (PP), polyurethane (PU), polyester, nylon or regenerated cellulose, or a mix of different fibres. The fibres may, for example, be present in the form of endless fibres of pre-fabricated fibres of a finite length, as synthetic fibres produced in situ, or in the form of staple fibres. The nonwovens according to the invention may thus consist of mixtures of synthetic and cellulose fibrous material, e.g. natural vegetable fibres (see ISO 9092, DIN EN 29092).

EMBODIMENTS OF INVENTION

Figure 1:
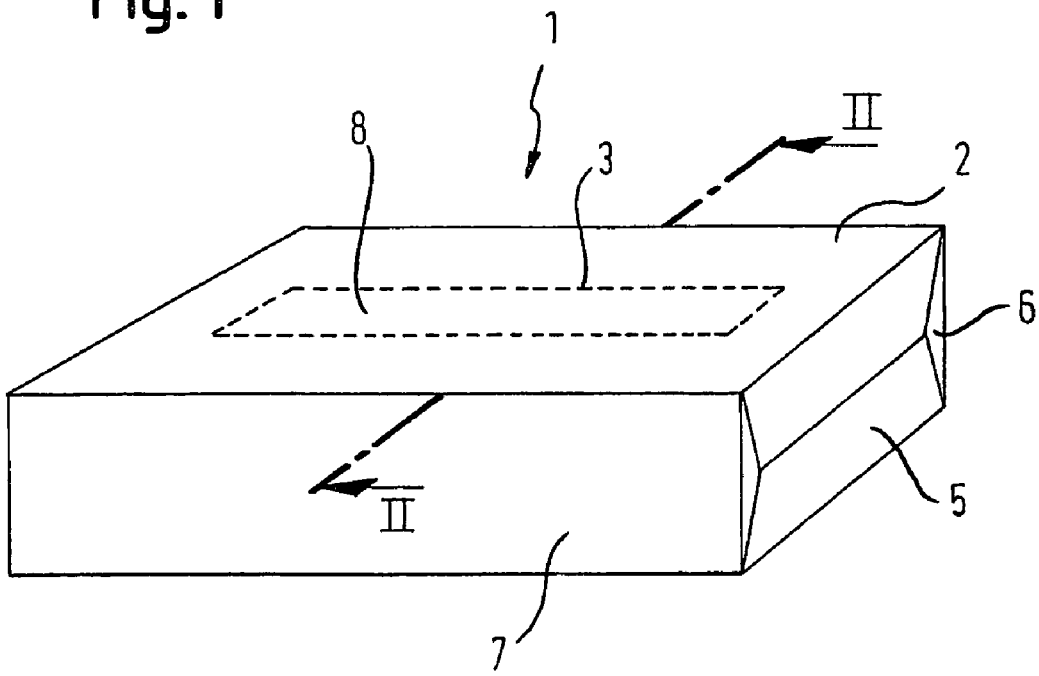
FIG. 1 is a perspective view of a container for a stack of individually removable paper products, in particular facial tissues.

The container 1 shown in FIG. 1 is usually formed from a folding blank as generally known for folded containers. The container forms an upper wall 2, an opposing substantially parallel base wall 4, and side walls 6 and side walls 7 formed by folding tabs 5. In the upper wall 2 is usually an opening 3 formed by a perforation and closed by the lid 8. Although not shown, on this lid is a grip tab with which the lid can be removed in conjunction with tearing open the perforation.

Figure 2:
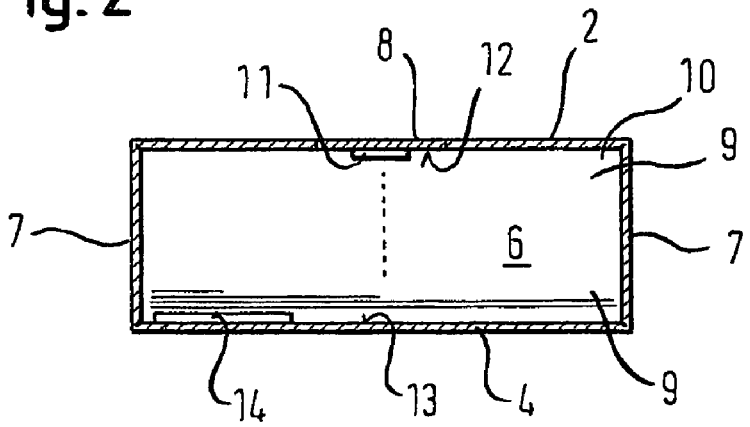
FIG. 2 is a section view through the container along line II-II in FIG. 1, in the assembled state of the container with contents.

FIG. 2 shows the stacked paper products, here facial tissues 9, of which the first top tissue 10 to be removed adheres to an adhesive surface 11 applied on the inner face 12 of the lid 8. This can be an adhesive mass as is generally known for releasable glue joints, so that the tissue 10 can be detached from the lid 8 and used. The adhesive surface can also be formed by a multiplicity of hooks which achieve mechanical adhesion with the fibre structure of the facial tissue.

When a filled container is to be opened to use the facial tissues 9, the user opens the lid 8 by tearing the perforation line 3. Normally the lid is removed. On this removal the lid 8 carries the first and uppermost tissue 10 which can thus easily be withdrawn from the content of the container. Normally this first tissue partly carries the second tissue with it, because in the stack the tissues are interleaved at least partly.

Figure 3:
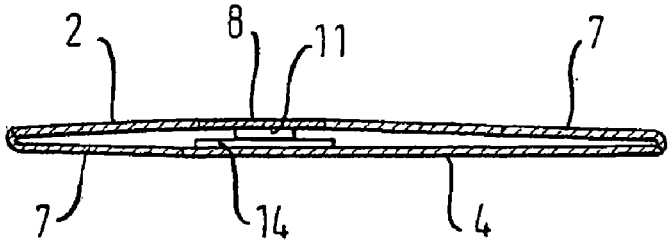
FIG. 3 is a similar section view through the container as in FIG. 2 but in the collapsed state of the container without contents.

On the inner face 13 of the base wall 4 according to the view in FIG. 2 is a separating surface 14 in the form of an applied layer or as an applied separating material or as surface material of the base wall 4 with a separating function. In the collapsed state of the container shown in FIG. 3, the adhesive surface 11 lies on the separating surface 14. This has the advantage that on storage and preparation of the folded blank for filling in a corresponding machine, the adhesive effect of the surface 11 is not lost, on assembly of the container, however, easy separation of the adhesive surface 11 from the separating surface 14 is possible without loss of the adhesive effect for later adhesion to the top first tissue.

Normally stacks of collapsed containers are supplied to the filling machine as container blanks. A suction element draws the outer face of the base wall, whereby the correspondingly collapsed container is separated from the rest of the stack and opened. The suction pressure is sufficiently high to unfold the collapsed container and detach the adhesive surface from the separating surface. The adhesive surface is then free for adhesion to the top facial tissue when the stack of tissues is inserted in the cavity of the container. Here it is advantageous if the container is transported into the production machine with the upper wall facing down. Rotation within this production line is easy to achieve.

The solution according to the invention is easy to implement during production of the container. Four fundamental steps are required:

1. The cardboard material is printed.
2. The printed cardboard material is cut into the final shape and all the fold lines and perforation lines produced.
3. Where an insert is used, this insert is cut and glued at the right points.
4. The container is assembled and glued in such a way that it can be handled in the packing process.

The separating surface 14 can be cut from a piece of silicon-treated paper and applied to the inner face 13 of the base wall 4 at the same time as the insert. This means that this is done during process step 3. The said insert can for example be a leaved window which partly closes the withdrawal opening after opening of the lid but nonetheless allows removal of the tissues.

The adhesive area 11 can easily be brought to the right point during process step 4. Suitable adhesive applications guarantee precise positioning even at high production speeds such as 40,000 containers per hour. The container is then finally collapsed during production, where in process step 4 the adhesive surface 11 and the separating surface 14 come into contact.

The invention claimed is:

1. A container for a stack of individually removable paper products, said container having:

an upper wall, in which a withdrawal opening is formed, said withdrawal opening is closed by means of a tear-off-able lid; and a cavity accommodating said stack of products, wherein the lid has on an inner surface an adhesive or bonding surface by means of which an uppermost paper product of the stack of products adheres to the lid, the container is a folded container formed from a blank, and has arranged spaced from the upper wall in an assembled state, a substantially parallel base wall, on an inner face of the base wall is formed a separating surface against which in a collapsed state of the container lies the adhesive or bonding surface.

2. The container according to claim 1, wherein the adhesive surface is coated with an adhesive provided with a spot of adhesive.

3. The container according to claim 1, wherein the adhesive or bonding surface is formed by a mechanical bonding part.

4. The container according to claim 1, wherein the separating surface is formed by a material application to the inner face of the base wall.

5. The container according to claim 1, wherein the separating surface is formed by a separating layer which is applied to the inner face of the base wall.

6. A container for a stack of individually removable non-woven products, said container being movable from a collapsed state to an assembled state and comprising:

an upper wall having a withdrawal opening, said withdrawal opening is closed by a removable lid; and a cavity accommodating said stack of non-woven products, wherein the lid has an inner surface facing said stack of non-woven products, said inner surface having an adhesive surface configured to adhere an uppermost non-woven product of the stack of non-woven products to the lid, and wherein the container is configured to be folded and formed from a blank, and further includes a substantially parallel base wall arranged spaced from the upper wall in the assembled state, said base wall having a separating surface formed on an inner face thereof, the adhesive surface being in contact with the separating surface when the container is in the collapsed state.

* * * * *